United States Patent [19]

Matsuda

[11] Patent Number: 4,995,126

[45] Date of Patent: Feb. 26, 1991

[54] CUSHION WITH HEATING PAD

[75] Inventor: Toshihiko Matsuda, Mino, Japan

[73] Assignee: Marumanji Sangyo Co., Ltd., Osaka, Japan

[21] Appl. No.: 512,747

[22] Filed: Apr. 23, 1990

[30] Foreign Application Priority Data

May 18, 1989 [JP] Japan ..... 1-57656[U]

[51] Int. Cl.[5] ..... A47C 21/04; A61F 7/08

[52] U.S. Cl. ..... 5/421; 5/468; 126/204; 126/263

[58] Field of Search ..... 5/421, 468, 448; 126/204, 263; 128/376, 403

[56] References Cited

U.S. PATENT DOCUMENTS 3,476,102 11/1969 Sarnoff ..... 126/204
3,951,127 4/1976 Watson et al. ..... 126/204
4,573,447 3/1986 Thrash et al. ..... 126/263
4,604,987 8/1986 Keltner ..... 5/421

FOREIGN PATENT DOCUMENTS 923758 4/1963 United Kingdom ..... 5/421

*Primary Examiner*—Alexander Grosz
*Attorney, Agent, or Firm*—Joseph W. Farley

[57] ABSTRACT

A cushion using disposable heat pads. A ventilated outer bag contains in its interior, a sheet having at its upper side a recessed air passage, disposable heat pads containing powders such as of oxidized metal and water-containing material, and a cushion, which are put in layers in this order from the lower side of the bag. The disposable heat pads are well ventilated from the air passage of the sheet laid thereunderneath, so that the heating effect can be improved.

2 Claims, 1 Drawing Sheet

CUSHION WITH HEATING PAD

FIELD OF THE INVENTION

This invention relates to a cushion containing disposable heat pads.

BACKGROUND OF THE INVENTION

It has been proposed to warm the body by using disposable heat pads containing exothermic materials which heat up in contact with air. In recent years, bags containing disposable heat pads have been used as cushions to sit on.

When such a bag containing disposable heat pads is used as a cushion, the disposable heat pads contained in the interior of the bag are pressed by the weight of a person sitting on the bag. Because of this, a problem arises in that the heat pads are poorly supplied with air and the heating effect becomes unsatisfactory.

SUMMARY OF THE INVENTION

This invention aims to solve this problem, having the object of improving the heating effect as well as providing a comfortable cushion to sit on.

In order to attain this object, the cushion of the present invention comprises a ventilated outer bag containing sheet means having a recessed air passage on the upper side, disposable heat pad means containing a powder composite such as oxidized metal and water-containable material, and cushion means, which are arranged in layers in this order from the lower side of the bag.

According to this construction, sufficient air can be supplied to the disposable heat pads from the air passage of the sheet means underneath, so that the heating effect can be improved. At the same time, the cushion means helps to make the cushion comfortable to sit on.

DESCRIPTION OF THE PREFERRED EMBODIMENTS

Figure 1:
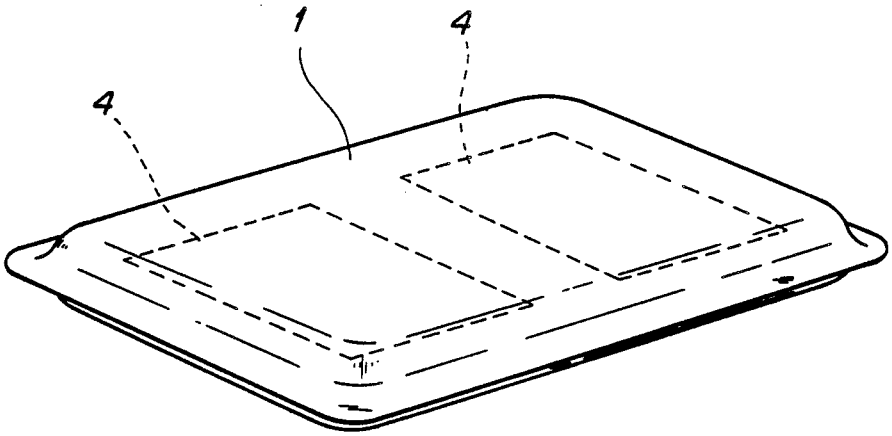
FIG. 1 is a perspective view of the outer appearance of a cushion embodying the present invention.
Figure 2:
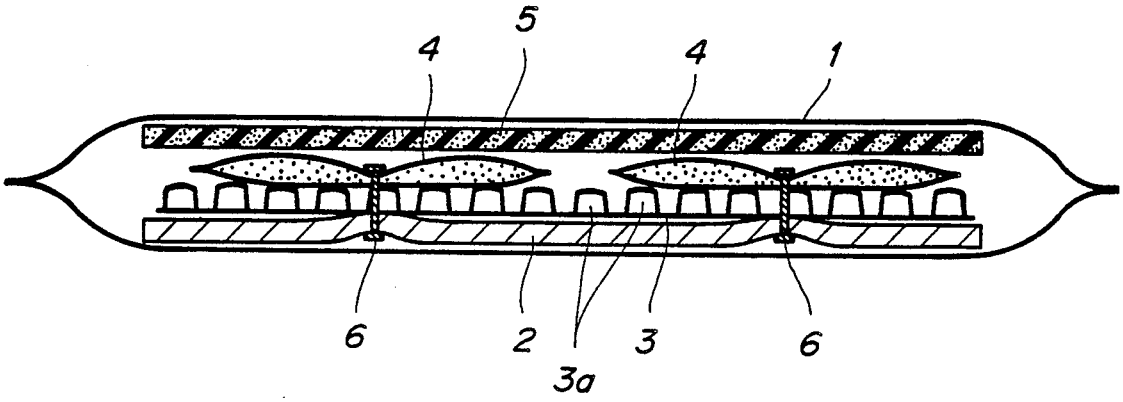
FIG. 2 is a sectional view of the cushion of FIG. 1.

In FIGS. 1 and 2, numeral 1 denotes a ventilated outer bag made of nonwoven fabric or laminated paper, which has numerous fine air holes. Orderly layered in the interior of the outer bag 1 are, from the lower side of the bag 1, a mat 2 made of nonventilative polyurethane, paper or the like; a sheet 3 of foamed buffer cushion; disposable heat pads 4 containing powders of oxidized iron, water-containing material and the like, which are so composed as to heat up in contact with air; and cushion material 5 made of urethane or the like.

The foamed buffer cushion 3 consists of a sheet of thin resin film having numerous air-containing protrusions 3*a*, which have adequate cushion effects and enable air to flow in from outside between the adjacent air-containing protrusions 3*a*. The foamed buffer cushion 3 is so arranged that its air-containing protrusions 3*a* are on its upper side adjacent to the lower surface of the disposable heat pads 4, and is fastened between the disposable heat pads 4 and the mat 2 by fasteners 6 penetrating said three layers. Used as the fasteners 6 are either staples or resin clips, by which the central thickness of the disposable heat pads 4 can be minimized.

According to the above construction, the formed buffer cushion 3 is laid underneath the disposable heat pads 4, so that air can easily enter the interior of the disposable heat pads 4 from underneath and activate the heating process. The disposable heat pads 4 are fastened onto the foamed buffer cushion 3 by the fasteners 6 and are therefore unable to move while used, thus contributing to stabilize the heating effect. The minimization of the central thickness of the disposable heat pads 4 decreases movement of the powder contained in the pads and accordingly the overall thickness of the disposable heat pads 4 can be kept almost constant. Since the cushion material 5 is placed over the disposable heat pads 4 and the foamed buffer cushion 3 is placed underneath the disposable heat pads 4, the cushion is comfortable to sit on.

In the above embodiment, the disposable heat pads 4 are fastened to the foamed buffer cushion 3 and the mat 2 by the fasteners 6. Instead, they may be fastened by sewing or by glue bonding. Also, the foamed buffer cushion element 3 provided underneath the disposable heat pads 4 may be replaced by other materials such as a sheet element having at its upper side a recessed air passage.

I claim:

1. A cushion comprising:

a ventilated outer bag (1) having a lower side and an upper side adapted to be contacted by the body of a user, said outer bag having an interior containing, in successive layers arranged between said lower and upper sides, mat means (2) positioned adjacent to said lower side;

sheet means (3) disposed above said mat means, said sheet means having on its upper side at least one recessed air passage;

disposable heat pad means (4) at the upper side of said sheet means (3);

cushion means (5) between said heat pad means (4) and said upper side of said outer bag; and fastener means (6) for interconnecting said mat means (2), sheet means (3) and heat pad means (4).

2. A cushion according to claim 1 wherein said sheet means consists of a sheet of thin resin film formed with numerous air-containing protrusions on its upper side.

* * * * *